United States Patent [19]

Wagoner

[11] Patent Number: 4,964,528

[45] Date of Patent: Oct. 23, 1990

[54] REMOVABLE AND ADJUSTABLE DIVIDER FOR COOLERS

[76] Inventor: Patrick K. Wagoner, Rte. 2, Box 276, Glen St. Marys, Fla. 32040

[21] Appl. No.: 395,755

[22] Filed: Aug. 18, 1989

[51] Int. Cl.[5] ..... B65D 5/48

[52] U.S. Cl. ..... 220/22.3; 220/22; 220/22.1; 220/22.2; 220/22.5; 62/372; 62/457.2; 229/120.02

[58] Field of Search ..... 220/22.5, 22.3, 22.2, 220/22.1, 22; 229/120.02, 117.01; 62/457.1, 457.2457.7, 372

[56] References Cited

U.S. PATENT DOCUMENTS

| | | | |
|---|---|---|---|
| Re. 32,740 | 8/1988 | Steffes | 62/457.7 |
| 560,893 | 5/1896 | Conant | 220/22.2 |
| 601,798 | 4/1898 | Slomka | 62/457.7 |
| 2,728,482 | 12/1955 | Driver | 220/22 |
| 3,412,920 | 11/1968 | Desforges | 229/120.02 |
| 4,164,312 | 8/1979 | Harned | 220/22 |
| 4,261,465 | 4/1981 | Thomas | 220/22.3 |
| 4,328,922 | 5/1982 | Hirata | 229/120.02 |
| 4,763,782 | 8/1988 | Sinchok | 220/22.2 |
| 4,860,889 | 8/1989 | Lemieux | 220/22 |
| 4,889,253 | 12/1989 | Schmulian | 220/22.3 |

*Primary Examiner*—Stephen Marcus
*Assistant Examiner*—S. Castellano

[57] ABSTRACT

A simple to use, fully adjustable, ice chest divider which provides for the isolation of food or other items from melted ice water is disclosed. The divider comprises a plurality of rectangular panels of various sizes, attached by slide hinges and additional hinging mechanisms, in such a manner as to be both continuously adjustable and collapsible. The self-supporting divider provides for unobstructed access to all compartments while permitting melted ice water to drain to drain plugs where applicable.

5 Claims, 2 Drawing Sheets

REMOVABLE AND ADJUSTABLE DIVIDER FOR COOLERS

BACKGROUND—FIELD OF INVENTION

This invention relates to dividers, specifically to such dividers used with portable ice chests and coolers to provide compartmentalization.

BACKGROUND—DESCRIPTION OF PRIOR ART

Originally, portable ice chests and coolers were marketed in a very simple box-like form. Since their introduction to the marketplace, various trays and molded structures have been incorporated to provide means of separating the coolant, (ice) from the contents to be cooled.

U.S. Pat. No. 4,577,475 to Herrera (1985) shows a chest with compartmentalization and removable bins for storage. However, the compartments are fixed and are functional only within the context of use with this particular cooler.

U.S. Pat. No. 4,260,085 to Jefferson (1981) shows a removable tray which separates beverage containers. The tray is supported over the ice compartment. While this arrangement provides a removable divider, it obstructs access to the ice compartment, is limited for use only with beverage cans, and would not be useable outside of the context of this particular ice chest.

It appears that many of the divider mechanisms relating to ice chests and coolers, were designed with only one particular application in mind. That is, to be used with only one specific cooler.

Several patents dealing more specifically with separation mechanisms were proposed. For example, U.S. Pat. No. 4,759,467 to Byrne (1988) describes a removable and flexible liner forming at least one non-communicating compartment. Although this apparatus deals with the concept of the removable divider, it does not however, address the concept of adjustability to operate with a variety of different sized coolers. In addition, since it is non-self-supporting, such an apparatus will require an extensive means of attachment in order to eliminate sagging and drooping of the flexible liner.

This non-rigidness would indeed lead to stretching and tearing of the liner, thus requiring the liner to be disposable after a few uses. The flexible liner provides no mention or means for allowing the removal of melted ice water in those instances where a water removal valve or faucet has been provided in the ice chest or cooler design.

U.S. Pat. No. 4,424,687 to Morgan (1984) discloses an ice rack which provides for the separation of the contents of a portable ice chest in two fashions; one fashion being horizontally and the other preferred fashion being vertically. However, this design calls specifically for the division of the ice chest into two compartments and provides for no means of adaptability to conform to the various requirements of different sized coolers. In addition, this arrangement provides no means for the securement of the dividing structure. Thus when operated in the preferred embodiment, the invention is subject to any dislodging forces.

OBJECTS AND ADVANTAGES

Accordingly, several objects and advantages of my invention are:

(a) to provide a universally adjustable ice cooler divider which thusly allows use with a wide variety of coolers;

(b) to provide, when desired, a totally removable cooler divider;

(c) to provide a collapsible cooler divider which can be folded into a compact position for storage;

(d) to provide a cooler divider which is rigid enough to support its own structures;

(e) to provide a cooler divider which upon opening of the cooler top, allows unobstructed access to the ice compartment, as well as all other compartments;

(f) to provide unobstructed flow of melted ice water to a drain valve if applicable to cooler design;

(g) to provide at least one vertical compartment which possesses the capability to protect its contents from saturation with melted ice water;

(h) to provide a cooler divider which is durable and reusable;

(i) to provide a cooler divider which is simple to use and inexpensive to manufacture;

Further objects and advantages of this invention will become apparent from a consideration of the ensuing description and drawings.

DRAWING FIGURES

FIG. 1 of the drawings shows a perspective view of the Wagoner Cooler Divider in the non-extended position with three of four optional self adhering guide bars.

REFERENCE NUMERALS IN DRAWINGS

Figure 1:
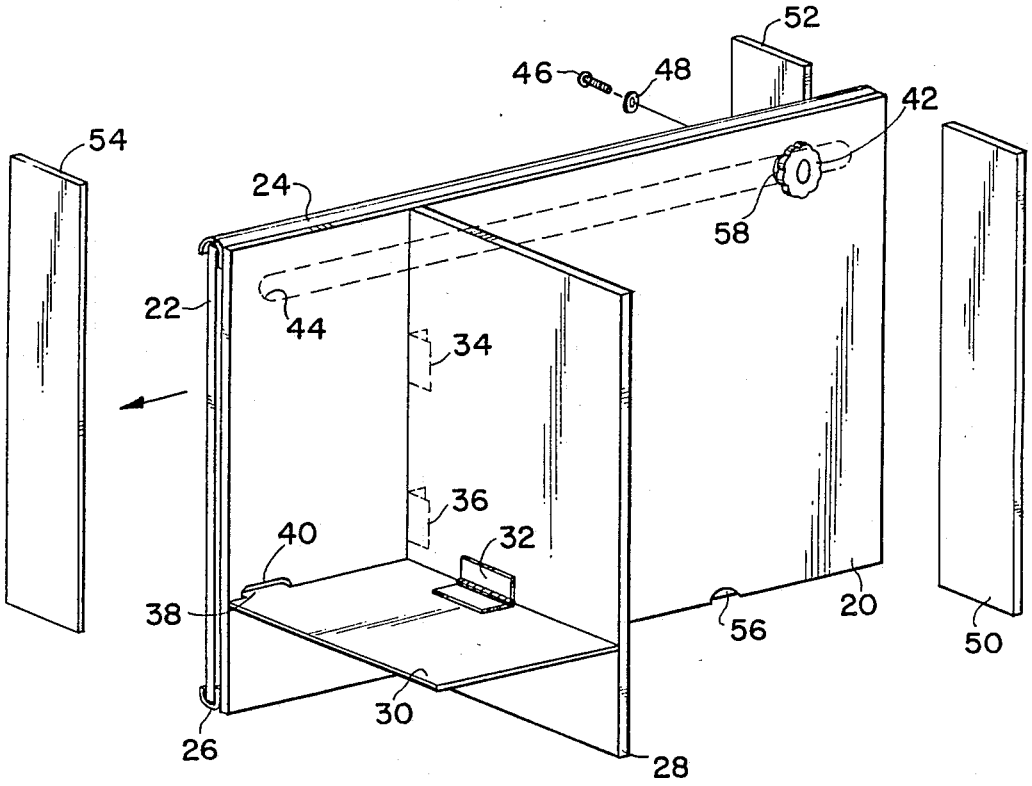

20: main stationary panel
22: main slide panel
24: top slide hinge
26: bottom slide hinge
28: vertical side panel
30: horizontal side panel
32: hinge
34: hinge
36: hinge
38: tab
40: hole
42: handwheel
44: slot in panel 22
46: bolt
48: washer
50: self-adhesive guide bar
52: self-adhesive guide bar
54: self-adhesive guide bar
56: notch
58: hole
59: channel type guide bar
60: channel type guide bar
62: living hinge
64: panel 1
66: panel 2
68: plastic laminate
70: plastic laminate.

DESCRIPTION—FIGURES 1 TO 4

A typical embodiment of the divider of the invention is illustrated in FIG. 1. The divider is comprised of two main panels; main stationary panel 20 and main slide panel 22, which are maintained adjacent by top and bottom slide hinges 24 and 26, respectively. In addition, a smaller vertical side panel 28 is maintained perpendicular to the main stationary panel 20, by hinges 34 and 36, when in the operating position.

In turn, smaller horizontal side panel 30 is maintained perpendicular to vertical side panel 28 and main stationary panel 20 via hinge 32, when in the operating position. The attitude of horizontal side panel 30 is secured by virtue of tab 38 interlocking in hole 40. Threaded handwheel 42 is secured by bolt 46 and washer 48 through hole 58 in main stationary panel 20 and slot 44 in main slide panel 22.

Notch 56 is located at the bottom of main stationary panel 20, while self-adhering guide bars 50, 52, and 54 are shown in reasonable proximity of their actual position as they would interface with the cooler walls. A fourth guide bar similar to bars 50, 52, and 54 is not shown in FIG. 1 since this would obscure the other components of the drawing.

Slot 44 is shown by dotted lines representing its location in the upper area of main slide panel 22.

Figure 2:
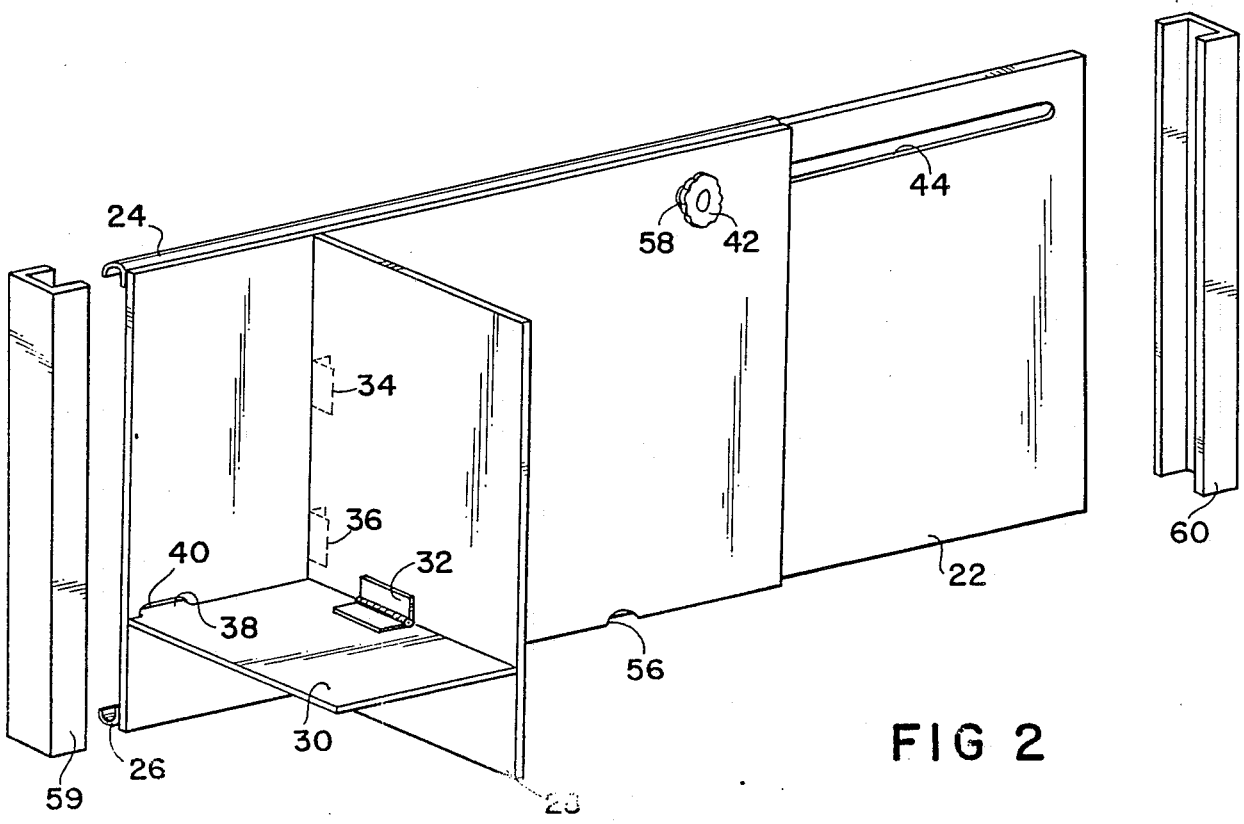
FIG. 2 shows the same perspective view but in one of the several extended positions with an alternative type of guide bar.

There are several possibilities with regards to the disposition of the self-adhering guide bars. In addition to the embodiment previously cited, the guide bars may be embodied not as strips but also as self-adhering plastic channels. FIG. 2 shows a similar view as FIG. 1 with the exception that the cooler divider is displayed in one of its extended positions secured by the plastic channel type guide bars 59 and 60.

Figure 3:
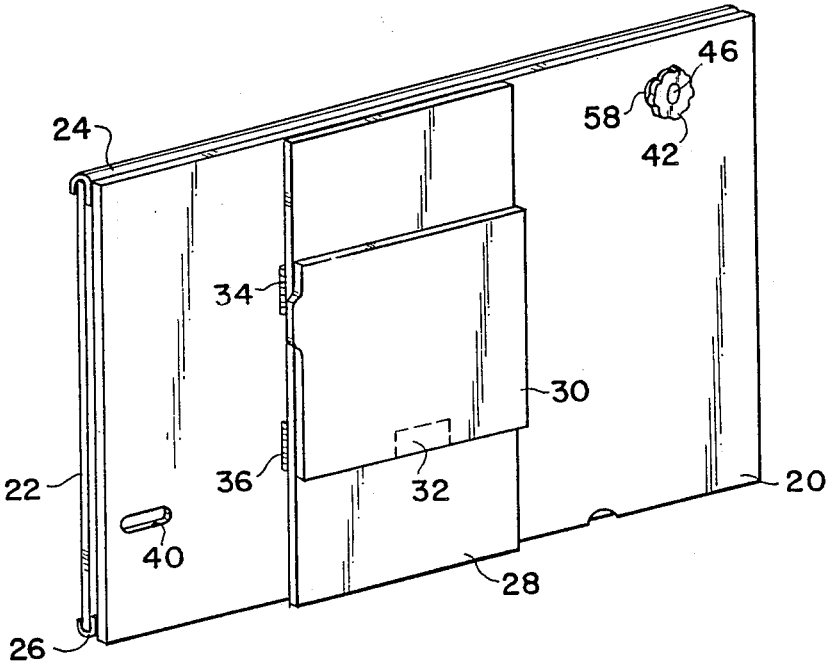
FIG. 3 shows the divider in its collapsed position.

FIG. 3 shows the invention in its collapsed and most compact form. No guide bars are shown in FIG. 3.

In the collapsed embodiment shown in FIG. 3, the hinges 32, 36, and 34 are in the closed position, allowing vertical side panel 28 and horizontal side panel 30 to lie in parallel relation and adjacent to main stationary panel 20 and main slide panel 22. Handwheel 42, bolt 46, and washer 48, in conjunction with hole 58 and slot 44, maintain the integrity of the invention in this position.

Figure 4:
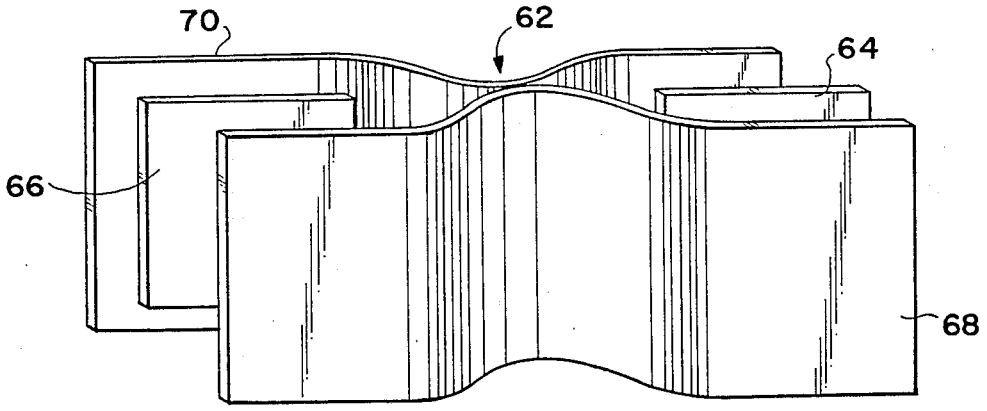
FIG. 4 shows an expanded view of a living hinge arrangement.

FIG. 4 shows an exploded view of a living hinge arrangement. Here, rigid panels 64 and 66 are sandwiched between sheets of thin, flexible, plastic laminates, 68 and 70, thereby forming a flexible hinge, termed a living hinge.

OPERATION—FIGS. 1,2,3,4

Operation of the Wagoner Cooler Divider is designed to be easy and simple. Panels 20, 22, 28, and 30 are constructed of lightweight plastics such as styrene or plexiglass. The hinges are acrylic and are secured by glue to their respective panels. Slide hinges 24 and 26 are also fabricated of plastic, as are all parts of the divider. However many other suitable plastics are available and could be used where appropriate. As an alternative embodiment for hinging the cooler divider, incorporates a living hinge arrangement. The living hinge arrangement is formed by the lamination of two layers of plastic material confining two or more rigid panels in such a way that the plastic laminate is free to bend at the juncture of the two rigid panels, thereby forming a hinge. This arrangement is shown in FIG. 4. In addition the rigid panel may be but is not limited to cardboard.

One inserts the divider into a cooler and loosens handwheel 42. This provides for main slide panel 22 to be extended to accommodate the length of the cooler being used. Tightening of handwheel 42 secures the extension of main slide panel 22 while top and bottom slide hinges 24 and 26, respectively, maintain the integrity of the apparatus in the extended position.

Next, vertical side panel 28 is rotated into position approximately perpendicular to main stationary panel 20 via hinges 34 and 36. The horizontal side panel 30 is rotated into position perpendicular to vertical side panel 28 and secured into position by the interlocking action of tab 38 into hole 40 with resulting final perpendicularity of vertical side panel 28 to main stationary panel 20.

If so desired, adhesive guide bars 50, 52, 54, and a fourth guide bar (not shown in figures), can be applied to cooler walls in such a way as to add further confinement to the positioning of the divider.

Notch 56 of FIGS. 1 and 2, allows for unobstructed flow of melted ice water.

Removal of the divider involves the reversal of the above cited installation procedure with the exception that the self-adhering guide bars may be left attached to the cooler walls for future use.

SUMMARY, RAMIFICATIONS, AND SCOPE

Accordingly, the reader will see that the Wagoner Cooler Divider of this invention, provides a convenient and functional means to efficiently compartmentalize many portable ice chests and coolers currently in the marketplace. The Wagoner Cooler Divider offers advantages not heretofore available, which set it apart from other types of dividers.

It permits rapid and integral adjustment to fit a wide range of coolers and ice chests.

It divides the ice chest and cooler into more than just two compartments while allowing unobstructed access to the storage and coolant (ice) compartments.

It provides for a special compartment which has the capability to disallow the contact between items in that compartment, and the melted ice water formed below.

It allows for the unobstructed transfer of melted ice water to the drainage valve if the cooler apparatus is so equipped.

It allows for the compact collapsibility of the structure in the event that non-use and storage is desired.

It is fully removable.

It is provided with a system of guide bars which guarantee the integrity of the invention with respect to the ice chest or cooler in which it will be used.

It is durable easily cleaned, and is reusable.

Although the description above contains many specificities, these should not be construed as limiting the scope of the invention, but as merely providing illustrations of some of the presently preferred embodiments of this invention.

For example, the divider could have additional compartments and panels, hinges could be fused to panels rather than glued, and dimensions could be increased or decreased as required.

Thus the scope of the invention should be determined by the appended claims and their legal equivalents, rather than by the examples given.

I claim:

1. A continuously adjustable partition, especially suitable for compartmentalization of a portable ice chest or cooler, comprising:

(a) a plurality of two larger rectangular panels;

(b) a plurality of two smaller rectangular panels;

(c) a slide hinge mechanism, enabling sliding movement of one of said two larger rectangular panels in a parallel plane, with respect to other of said two larger rectangular panels;

(d) a locking mechanism providing for the intermittent securement of said plurality of two larger rectangular panels, with respect to movement in said parallel planes;

(e) a plurality of hinges of the leaf type, enabling attachment of one of said two larger rectangular panels to a first of said two smaller rectangular panels and in addition, enabling attachment of said first of said two smaller rectangular panels to a second of said two smaller rectangular panels, whereby all of the larger and smaller rectangular panels are allowed to reorient thus resulting in a less voluminous arrangement.

2. The partition of claim 1 wherein said partition is made of plastic.

3. The partition of claim 2 wherein said partition is removable.

4. The partition of claim 3 wherein one of said two smaller rectangular panels functions horizontally and provides for separation of food items from melted ice water.

5. The partition of claim 3 wherein said partition is maintained in position by selfadhering guide bars.

* * * * *